US011773556B2

(12) United States Patent
Currey

(10) Patent No.: US 11,773,556 B2
(45) Date of Patent: Oct. 3, 2023

(54) VIBRATORY COMPACTOR

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

(21) Appl. No.: 17/660,159

(22) Filed: Apr. 21, 2022

(65) Prior Publication Data

US 2022/0267977 A1 Aug. 25, 2022

Related U.S. Application Data

(63) Continuation-in-part of application No. 17/647,241, filed on Jan. 6, 2022, now Pat. No. 11,447,922, which is a continuation-in-part of application No. 17/397,369, filed on Aug. 9, 2021, now Pat. No. 11,649,602, which is a continuation of application No. 16/989,373, filed on Aug. 10, 2020, now Pat. No. 11,085,159, which is a continuation of application (Continued)

(51) Int. Cl.

| | |
|---|---|
| ***E02D 3/046*** | (2006.01) |
| ***E01C 19/30*** | (2006.01) |
| ***E02F 3/96*** | (2006.01) |
| ***E02F 5/22*** | (2006.01) |
| ***B06B 1/18*** | (2006.01) |

(52) U.S. Cl.

CPC ..... *E02D 3/046* (2013.01); *B06B 1/183* (2013.01); *E01C 19/30* (2013.01); *E02F 3/967* (2013.01); *E02F 5/223* (2013.01); *B06B 2201/73* (2013.01)

(58) Field of Classification Search

CPC ..... E01C 19/30; E01C 19/32; E01C 19/34; E01C 19/35; E02D 3/046

See application file for complete search history.

(56) References Cited

U.S. PATENT DOCUMENTS 3,128,682 A 4/1964 Thompson et al.
3,749,506 A * 7/1973 Lance ..... E02D 3/046 404/133.2

(Continued)

FOREIGN PATENT DOCUMENTS

| | | |
|---|---|---|
| CN | 209368918 | 9/2019 |
| JP | H11158860 | 6/1996 |
| KR | 20110111681 | 10/2011 |

OTHER PUBLICATIONS

Korean document (KR 20150037016), pp. 16 (Year: 2015).*

*Primary Examiner* — Sunil Singh
(74) *Attorney, Agent, or Firm* — Schmeiser, Olsen & Watts, LLP

(57) ABSTRACT

A vibratory compactor is provided. The vibratory compactor may include at least one load bearing member coupled to a load bearing base and a frame coupled to a compactor plate with the load bearing base coupled to the frame. The frame and compactor plate are configured to vibrate. The vibratory compactor may also include a housing having an inner volume, the housing coupled to the frame by at least one isolator with the frame and the at least one load bearing member located within the inner volume. The housing may be coupled to an arm of an excavator. In response to force being applied to the housing by the excavator during compaction, the housing moves with respect to the frame until a top member of the housing contacts the at least one load bearing member and compacts soil more effectively than a vibratory compactor without the load bearing member.

10 Claims, 22 Drawing Sheets

Related U.S. Application Data

No. 16/691,240, filed on Nov. 21, 2019, now Pat. No. 10,738,434.

(56) References Cited

U.S. PATENT DOCUMENTS

| | | | | |
|---|---|---|---|---|
| 4,043,694 | A * | 8/1977 | Mullen | E02D 3/074 404/133.2 |
| 9,926,677 | B1 | 3/2018 | Beckhusen et al. | |
| 9,938,672 | B2 | 4/2018 | Jordan | |
| 9,988,770 | B1 | 6/2018 | Jordan | |
| 10,738,434 | B1 | 8/2020 | Currey | |
| 11,085,159 | B2 | 8/2021 | Currey | |
| 2018/0100276 | A1 | 4/2018 | Beckhusen | |

* cited by examiner

VIBRATORY COMPACTOR

CROSS REFERENCE TO RELATED APPLICATION[S]

This application a continuation-in-part of U.S. patent application Ser. No. 17/647,241, filed on Jan. 6, 2022, which is a continuation-in-part of U.S. Patent Application Ser. No. 17/397,369, filed on Aug. 9, 2021, which is a continuation of U.S. patent application Ser. No. 16/989,373, filed on Aug. 10, 2020, now U.S. Pat. No. 11,085,159, issued Aug. 10, 2021, which is a continuation of U.S. patent application Ser. No. 16/691,240, filed on Nov. 21, 2019, now U.S. Pat. No. 10,738,434, issued Aug. 11, 2020, the disclosures of which are incorporated entirely herein by reference.

BACKGROUND OF THE INVENTION

Technical Field

This invention relates generally to a compactor and more particularly to a vibratory compactor for use with excavator type vehicles.

State of the Art

Vibratory plate compactors are designed to compact lose material, such as soil, gravel, small aggregate, asphalt and so forth. Conventional plate compactors include a heavy plate on the bottom of the machine that moves up and down quickly. The combination of rapid impacts, plate weight and impact forces the soil underneath to compact or pack together more tightly. These plate compactors can be powered by gas engines or by hydraulic motors. Plate compactors that operate with hydraulic fluid are typically used with excavators or back hoes as an attachment. However, these hydraulic plate compactors are limited in their capability because the exposed hoses and further are not true vibratory compactors but have cyclic up and down motions wherein the amplitude of the up and down motion and the weight of the plate combine for the compaction. Often, these vibratory compactors cannot and should not have extra forces applied by the arm of the excavator or backhoe, but rather rest on the surface and the plate performs the function.

Accordingly, there is a need for an improved vibratory compactor for use with excavator type vehicles.

SUMMARY OF THE INVENTION

An embodiment includes a vibratory compactor comprising: at least one load bearing member coupled to a load bearing base; a frame coupled to a compactor plate with the load bearing base coupled to the frame, wherein the frame and compactor plate are configured to vibrate; and a housing comprising an inner volume, the housing coupled to the frame by at least one isolator with the frame and the at least one load bearing member located within the inner volume of the housing, wherein the housing is configured to couple to an arm of an excavator, and wherein: in response to force being applied to the housing by the excavator during compaction of soil, the housing moves with respect to the frame until a top member of the housing contacts the at least one load bearing member and compacts soil more effectively than a vibratory compactor without the load bearing member.

Another embodiment includes a vibratory compactor comprising: at least one load bearing member; a frame coupled to a compactor plate with a load bearing base coupled to the frame, wherein the frame and compactor plate are configured to vibrate; and a housing comprising a top member and an inner volume, wherein at least one load bearing member is coupled to the top member of the housing and the housing is coupled to the frame by at least one isolator with the frame and the at least one load bearing member located within the inner volume of the housing, wherein the housing is configured to couple to an arm of an excavator, and wherein: in response to force being applied to the housing by the excavator during compaction of soil, the housing moves with respect to the frame until load bearing base contacts the at least one load bearing member and compacts soil more effectively than a vibratory compactor without the load bearing member.

Another embodiment includes a method of use of a vibratory compactor comprising: coupling a vibratory compactor to an excavator, the vibratory compactor comprising: at least one load bearing member; a frame coupled to a compactor plate on one side and to a load bearing base on a side opposing the compactor plate; and a housing comprising an inner volume, the housing coupled to the frame by at least one isolator, the frame located within an inner volume of the housing and the at least one load bearing member located between the housing and the frame; applying force to the housing by the excavator during compaction; moving the housing with respect to the frame until a top member of the housing contacts the at least one load bearing member on one side and the load bearing base contacts the at least one load bearing member on an opposing side; and compacting soil more effectively than a vibratory compactor without the load bearing member.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
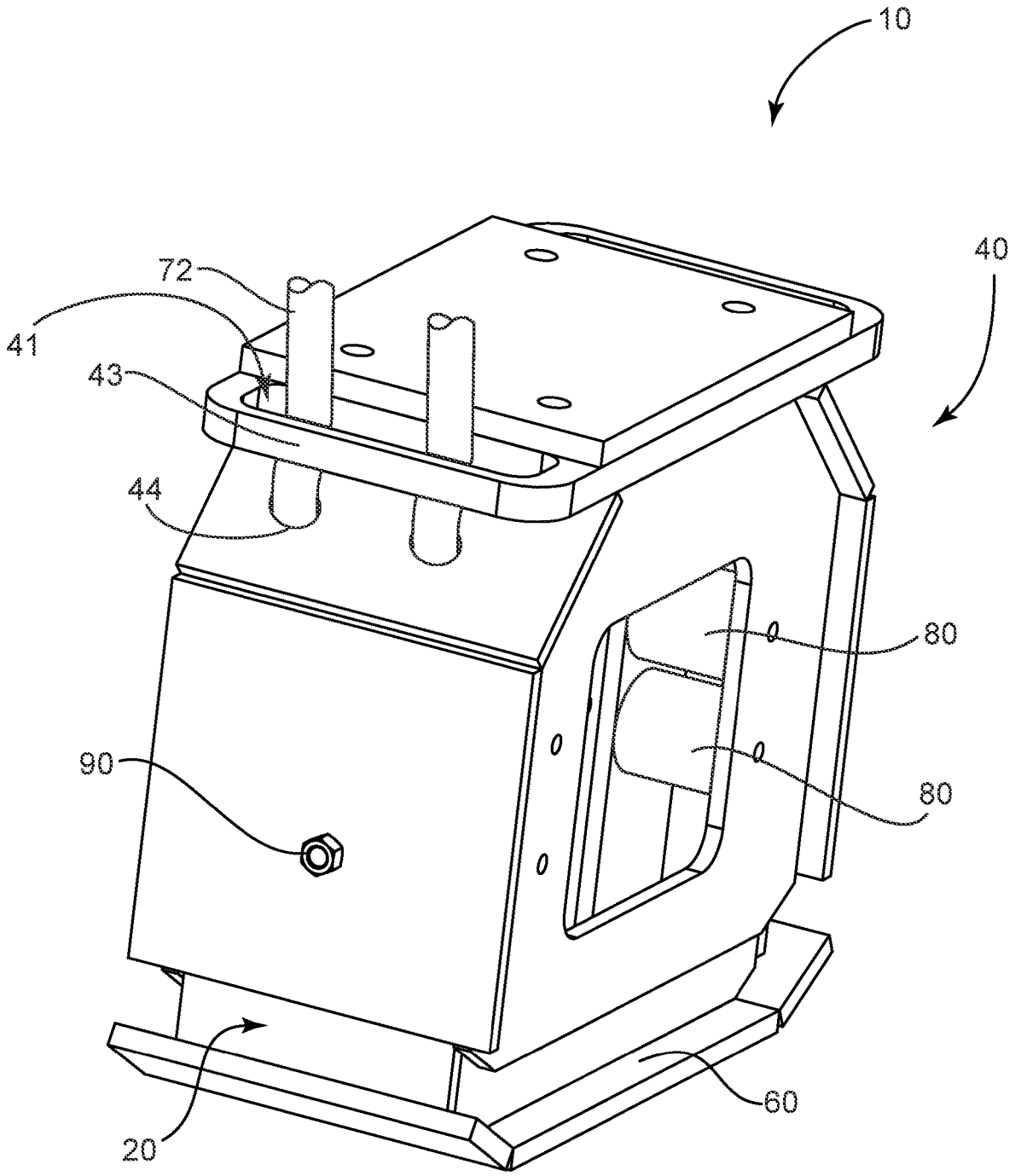
FIG. 1 is a perspective view of a vibratory compactor in accordance with an embodiment.
Figure 2:
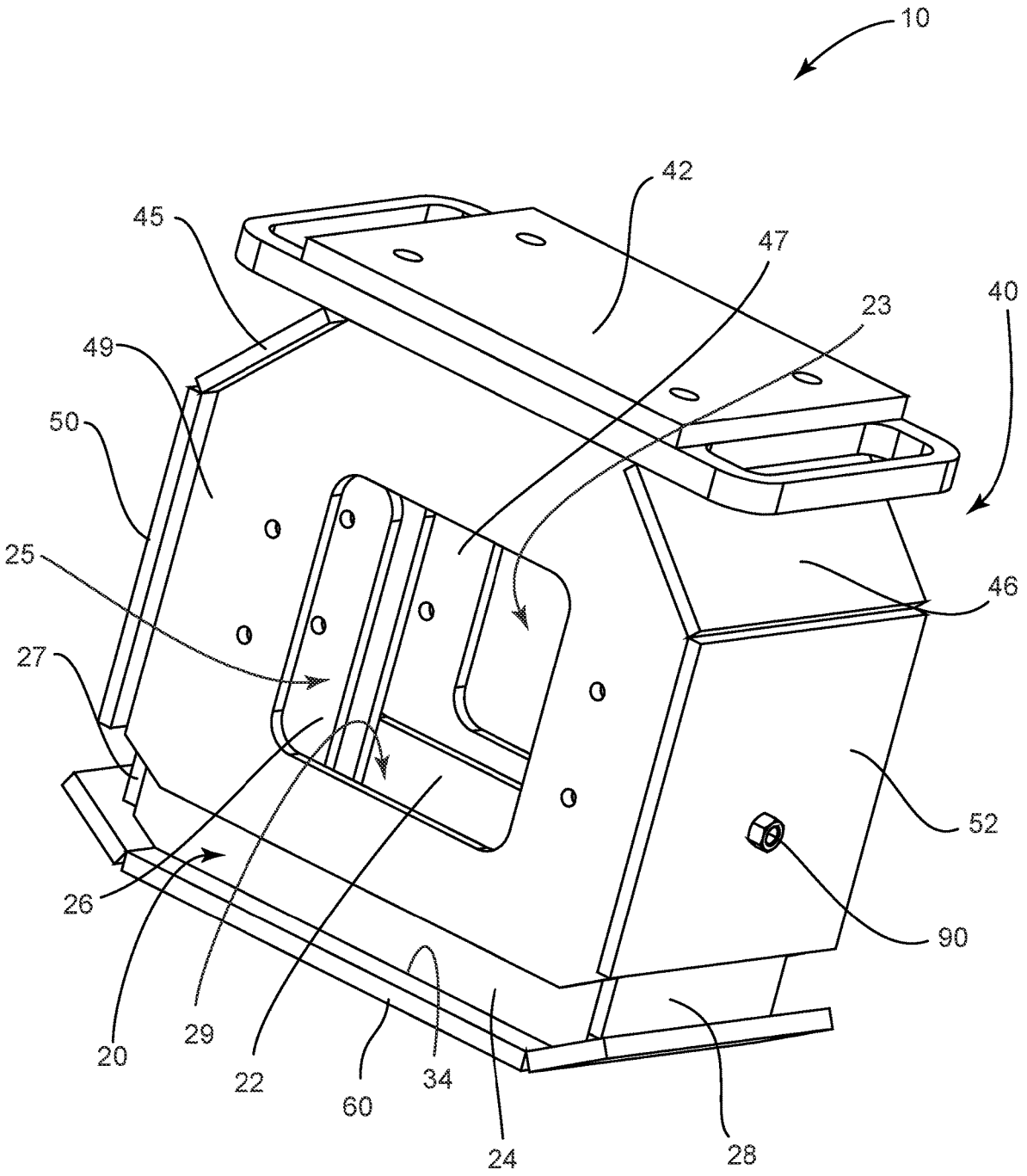
FIG. 2 is another perspective view of a vibratory compactor in accordance with an embodiment.
Figure 3A:
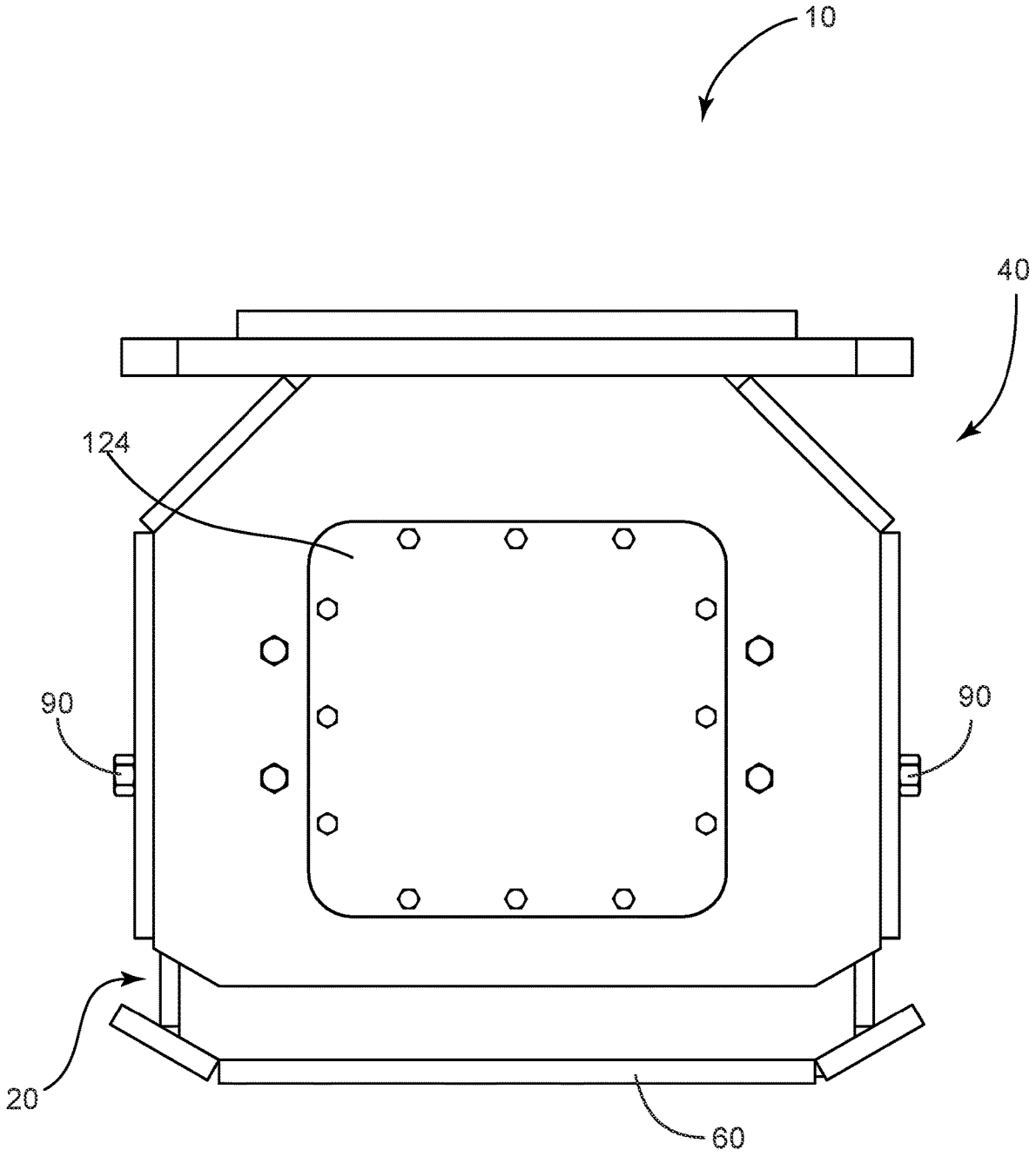
FIG. 3A is a side view of a vibratory compactor in accordance with an embodiment.
Figure 3B:
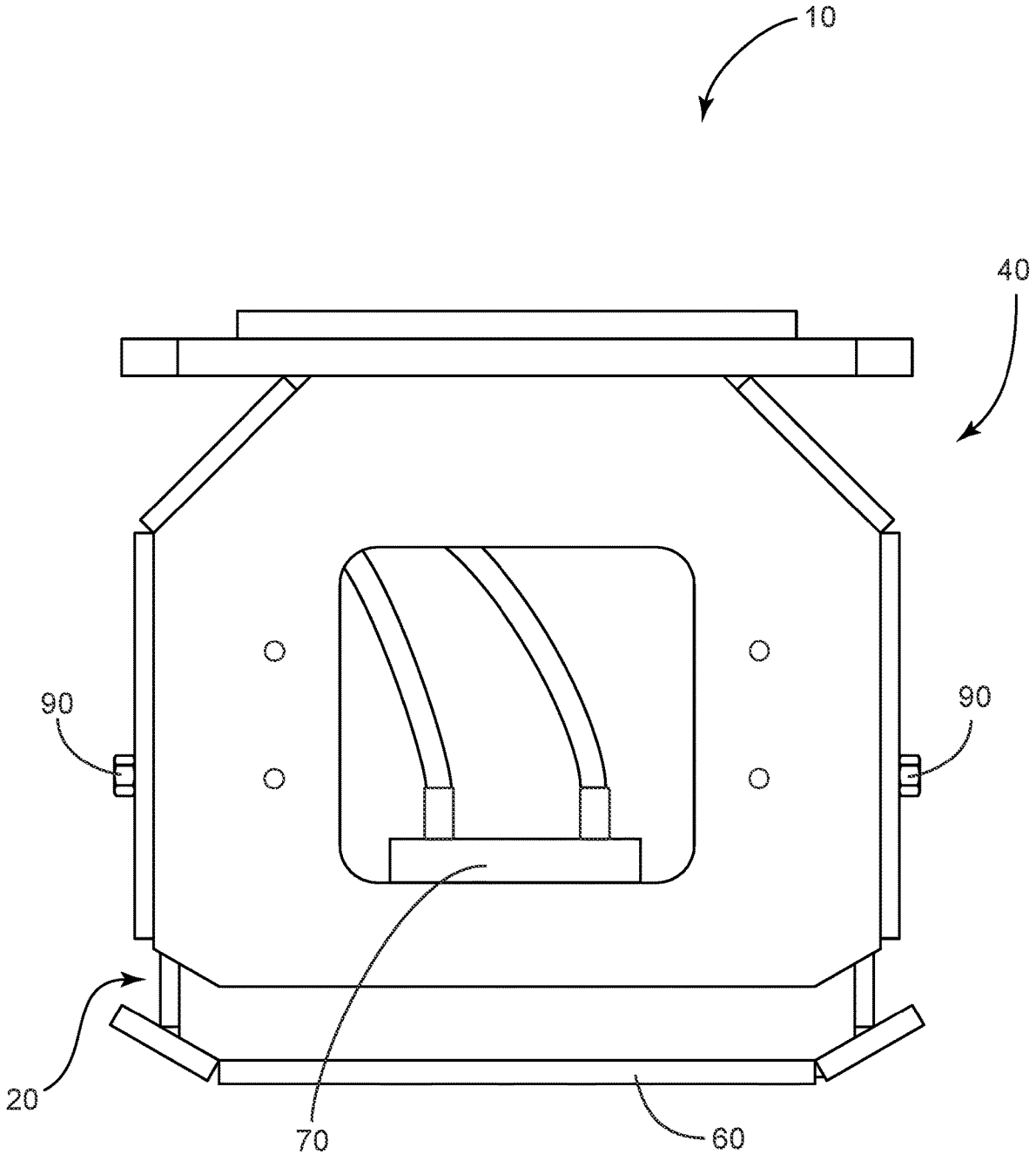
FIG. 3B is a side view of a vibratory compactor with a cover plate removed in accordance with an embodiment.
Figure 4:
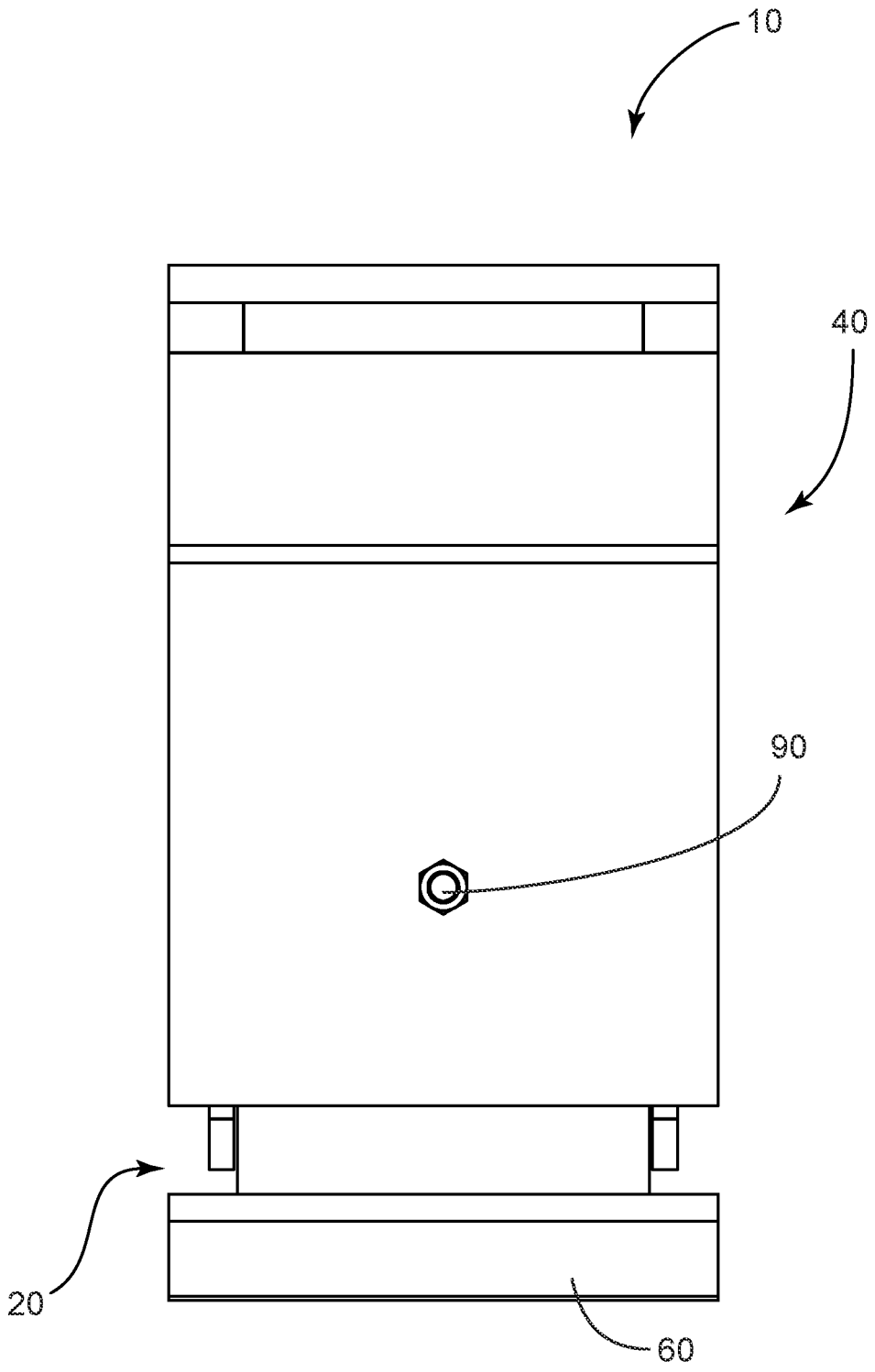
FIG. 4 is a front view with a front member of a housing removed from a vibratory compactor in accordance with an embodiment.
Figure 5:
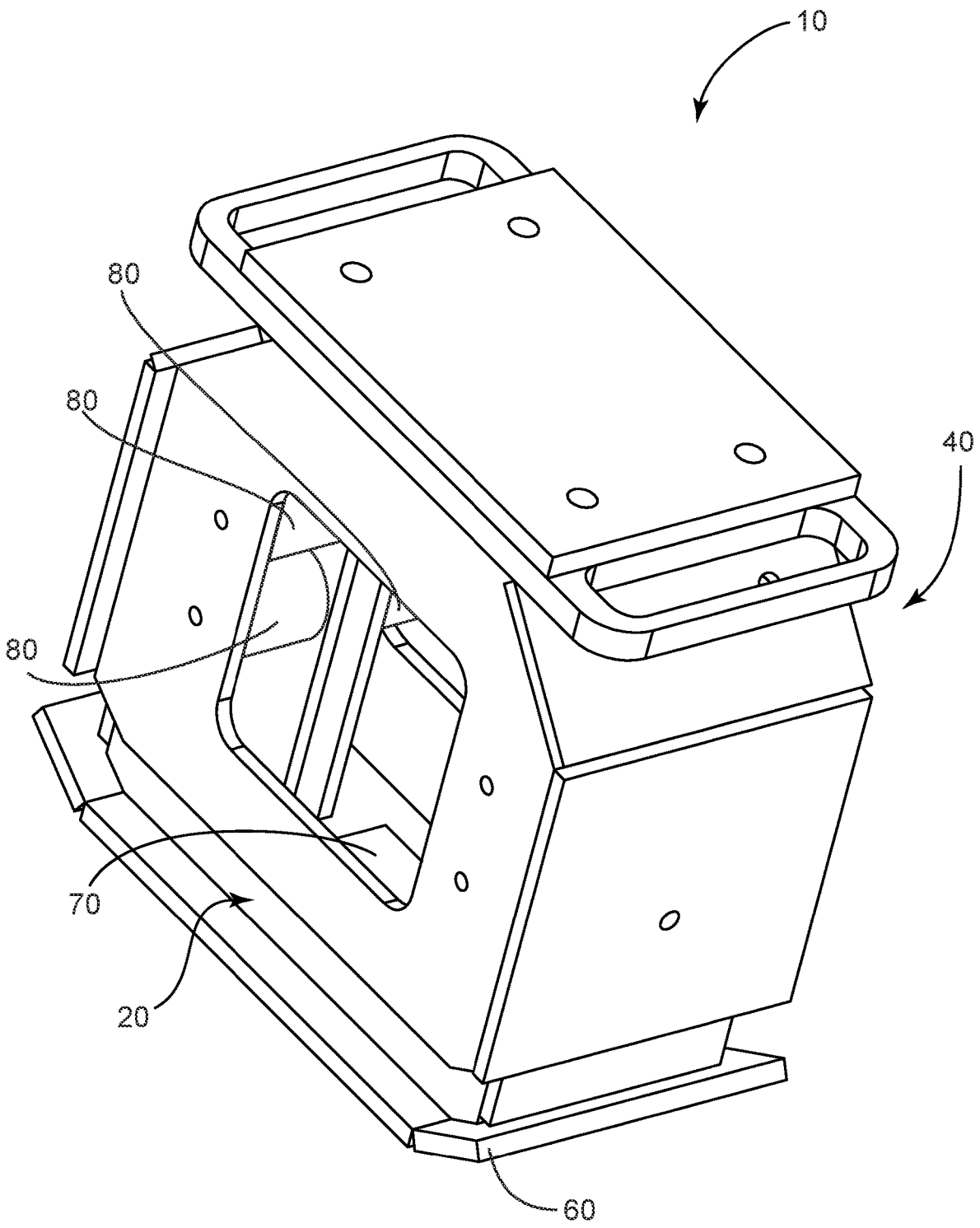
FIG. 5 is another perspective view of a vibratory compactor in accordance with an embodiment.

As discussed above, embodiments of the present invention relate to a vibratory compactor for use with an excavator type vehicle. An excavator type vehicle may be an excavator, a backhoe, a mini-excavator, or the like.

Referring to FIGS. 1-10, an embodiment of a vibratory compactor 10 is shown. The compactor 10 comprises a frame 20, a housing 40, a compactor plate 60 and a vibration generation device 70. The frame 20 comprises a first side member 22 spaced apart from a second side member 24 and a front member 28 spaced apart from a rear member 27, wherein the side members 22 and 24 with the front member 28 and the rear member 27 are coupled together to form a rectilinear inner space 29. The frame 20 may further comprise a plurality of mounting brackets 26 coupled between the first side member 22 and the second side member 24 and the between the front member 28 and the rear member 27. It will be understood that various amounts of mounting brackets 26 and orientations of coupling the mounting brackets 26 may be utilized. Further, it will be understood that the size and/or number of mounting brackets 26 utilized may correspond with the size of the vibratory compactor 10. The frame 20 may be coupled to the compactor plate 60. The vibration generation device 70 may be coupled to the compactor plate 60 within the inner space 29 of the frame 20. In embodiments, the vibration generation device 70 may be coupled directly to the compactor plate 60. The compactor plate 60 may include apertures wherein a larger compactor plate may be coupled to a bottom of the compactor plate 60.

The housing 40 may include a top member 42, chamfered members 45 and 46, a first side member 47, a second side member 49, a rear member 50 and a front member 52 coupled together to form the housing 40 with an open end providing access to an inner volume 54. The opening and inner volume 54 are configured to receive the frame 20 within the inner volume 54 of the housing 40. All of the holes for coupling components to each may be tapped holes and comprise threads. This allows for coupling of components together without the need of nuts. For example, and without limitation, the top member 42 of the housing 40 includes various amounts of threaded holes that are configured to allow various sized couplers (ears) to be coupled to or bolted to the top member 42 without the need for nuts.

The vibratory compactor 10 may further comprise a plurality of isolators 80. Each isolator 80 may be coupled to one mounting bracket of the plurality of mounting brackets 26 on one end and to a side member 47 or 49 of the housing 40 on the other end. A portion of each isolator 80 is within the inner space 29 and a portion of each isolator 80 extends beyond edges of the first side member 22 and the second side member 24. The housing 40 may be coupled to the plurality of isolators 80, wherein the housing 40 comprises couplers 82 removably coupled to a top member 42 of the housing 40. The coupler 82 may be configured for coupling the vibratory compactor 10 to an excavator type vehicle.

In embodiments, the first side member 22 of the frame 20 may comprise an aperture 23 providing access to the inner space 29. The second side member 24 of the frame 20 may comprise an aperture 25 providing access to the inner space 29. After assembly, the apertures 23 or 25 may be covered with a cover plate 124. Additionally, in some embodiments, the first side member 22, the second side member 24, front member 28 and rear member 27 are coupled to the compactor plate 60 forming a dust/debris seal 34 to inhibit dust/debris from entering the inner space 29.

In embodiments, the vibration generation device 70 is a hydraulic vibration generation device. In these embodiments, the housing 40 may comprise apertures 44 configured for hydraulic hoses 72 to extend therethrough from the excavator type vehicle to the hydraulic vibration generation device 70. In other embodiments, the housing 40 may comprise fittings configured for hydraulic hoses to extend between the excavator type vehicle and one side of the fittings and configured for hydraulic hoses 72 to extend between an opposed side of the fittings and the hydraulic vibration generation device 70. The fittings may be located in the same place as the apertures 44. For example, the fittings may be coupled within the apertures 44.

In each of these embodiments, the apertures 44 are located toward a top of the housing 40 and not extending out of any of the sides of the housing 40. For example, the apertures 44 may be located in one of the upper chamfered members 45 or 46. The apertures located toward a top of the housing and not extending from the side, limits the opportunity for damage to the hoses or fittings. This is a distinction over prior art wherein prior art has hoses and fittings open to the environment and allows for damage to easily occur to the hoses and/or fittings. In embodiments of this invention, the fittings for hoses to the vibration generation device 70 are located within the inner space 29 of the frame 20 and the apertures 44 with or without fittings are located in an upper surface that limits damage that may occur during use. The configuration of the frame 20 and the housing 40 operate to protect the hoses 72 and fittings for operation of the vibration generation device 70. Additionally, the top member 42 of the housing 40 may include handles 43. The handles 43 operate to lift the housing 40 for coupling to the frame 20 and to lift the vibratory compactor 10 if needed. Further still, the hoses 72 may extend from the apertures 44 and through the handle opening 41 and serves as a further protection from damage to the hoses 72 during operation of the vibratory compactor 10 (see FIG. 1).

With additional reference to the isolators 80, the plurality of isolators 80 isolate the vibration of the compactor plate 60 and frame 20 from the housing 40. Additionally, the plurality of isolators 80 are oriented to allow forces to be applied to vibratory compactor 10 from operation of the excavator type vehicle in one or more directions comprising perpendicular to the compactor plate 60 and any angle to the compactor plate 60. As shown, the isolators may be cylindrical in shape and more than one isolator may be coupled to one bracket member 26 and the housing 40. It will be understood that as shown, the bracket members 26 may be elongate members with apertures that are configured to couple isolators 80 in parallel configuration on the same side of the bracket member 26. The vibratory compactor 10 may further comprise a gap 48 between the housing 40 and the frame 20 and the housing 40. The gap 48 allows for movement between the housing and the frame and the isolators operate to dampen the movement of the housing 40 during vibration of the plate 60 and the frame 20 when the vibratory compactor 10 is operating.

Figure 6A:
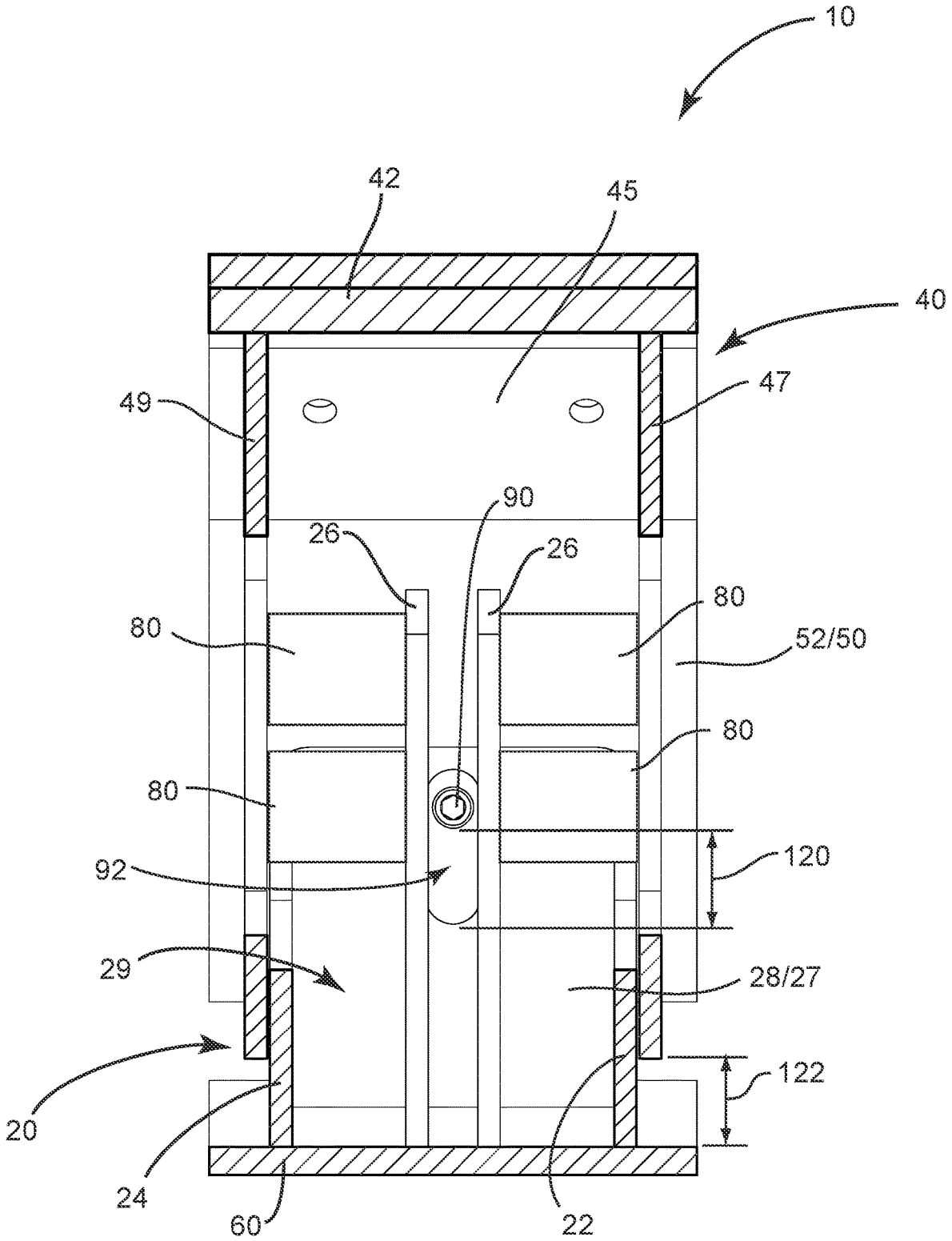
FIG. 6A is a section view of a vibratory compactor in accordance with an embodiment.
Figure 6B:
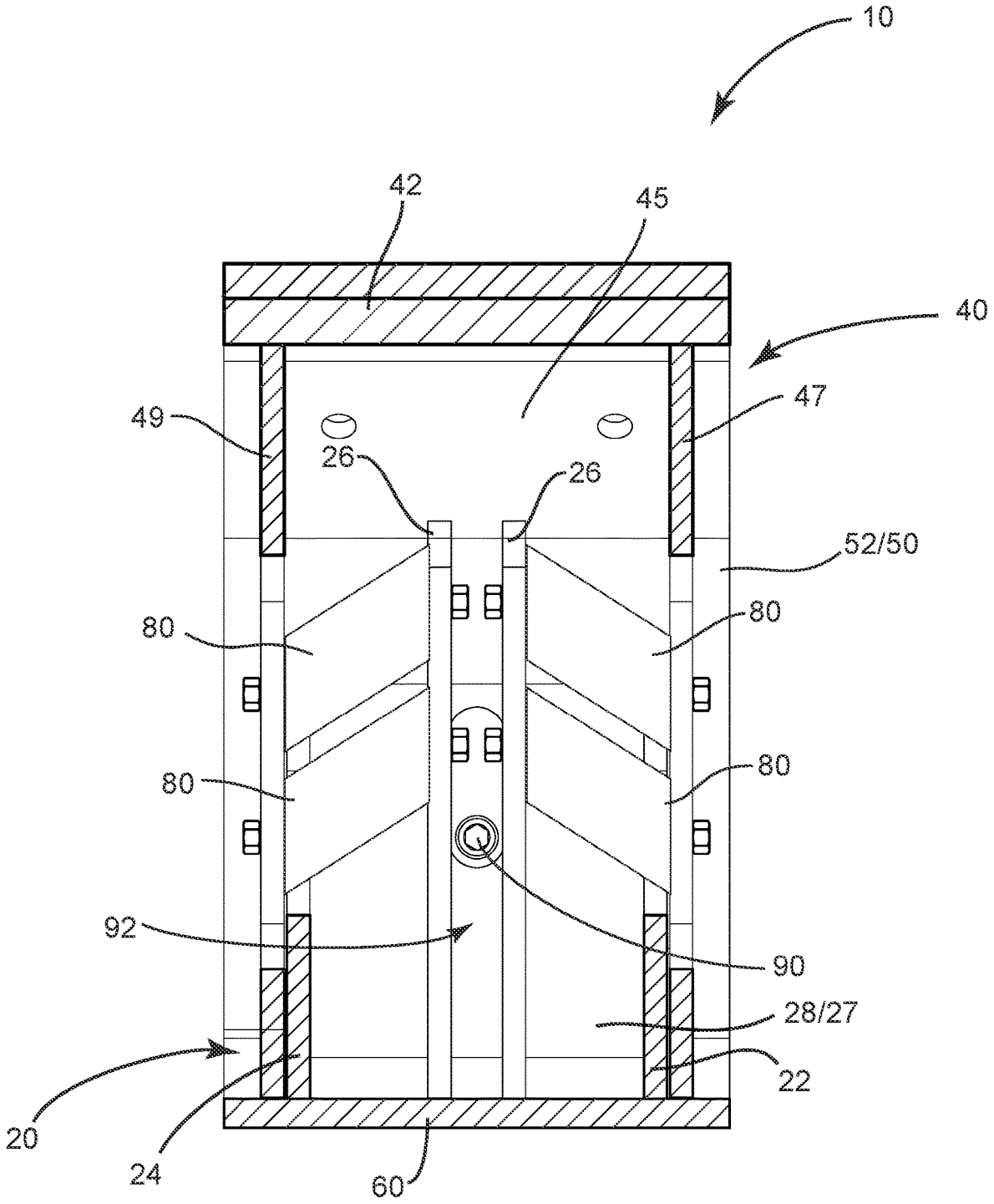
FIG. 6B is a section view of a vibratory compactor with a compressing force applied to the housing in accordance with an embodiment.
Figure 6C:
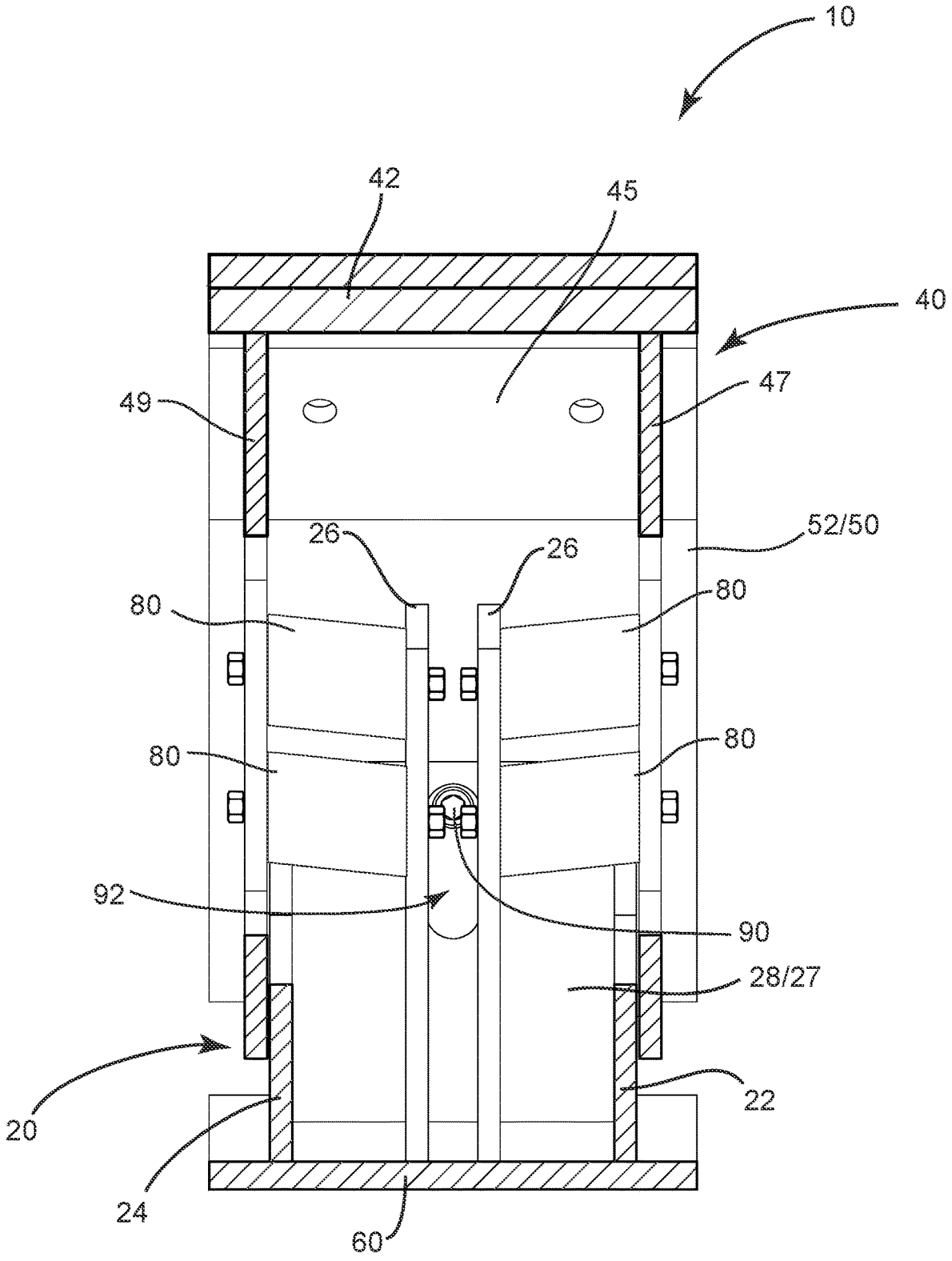
FIG. 6C is a section view of a vibratory compactor with a pulling force applied to the housing in accordance with an embodiment.
Figure 7:
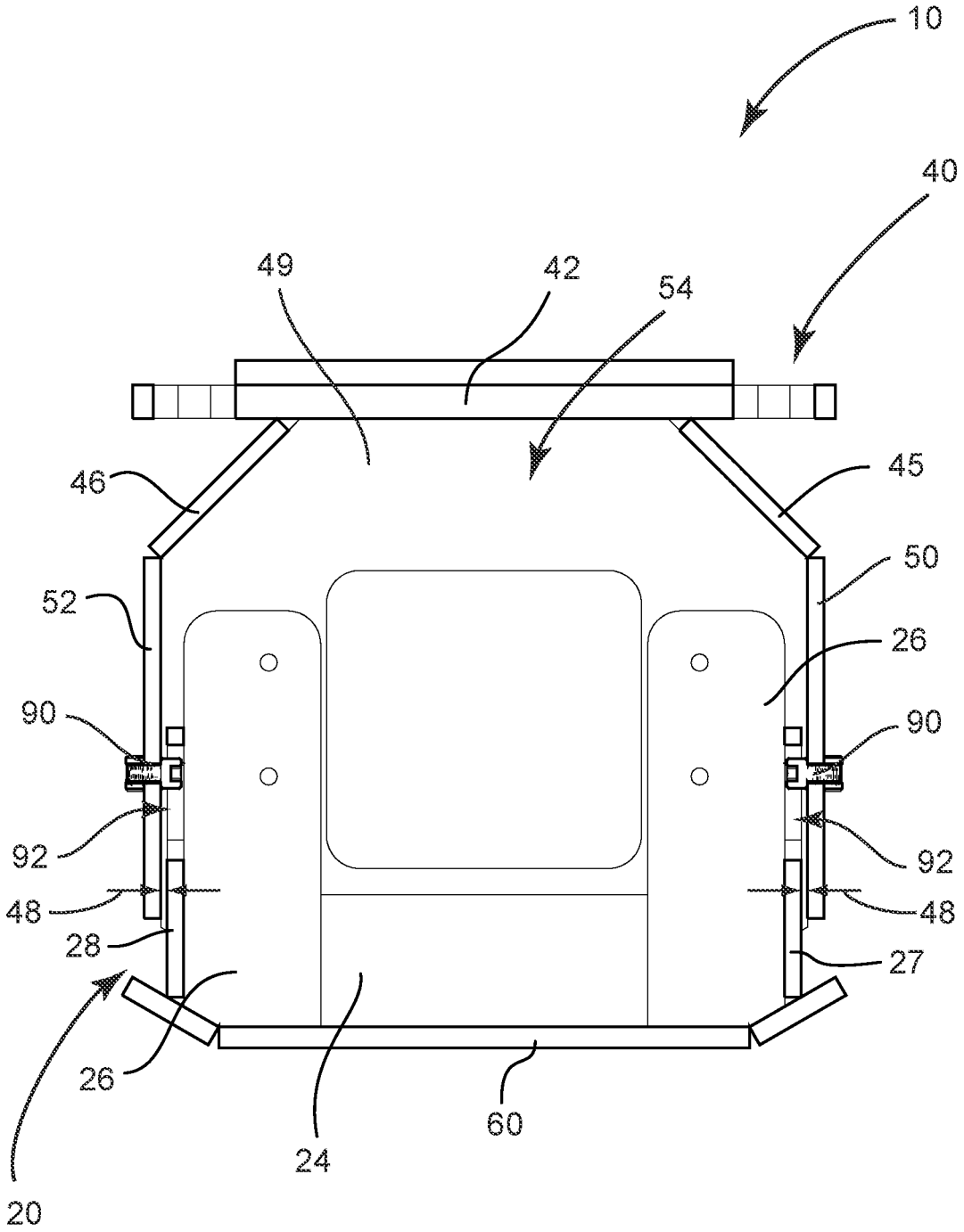
FIG. 7 is another section view of a vibratory compactor in accordance with an embodiment.

The front member 52 and the rear member 50 of the housing 40 may include apertures with control members 90, such as bolts, coupled through the apertures. The front member 28 and the rear member 27 of the frame 20 may include an elongate aperture 92 formed through the front member 28 and the rear member. Referring to FIGS. 6A-6C, the location of the elongate aperture 92 that allows the control member 90 to extend within the elongate aperture 92 with the housing 40 coupled to the frame 20 with isolators 80. The location of the control member 90 within the elongate aperture 92 is such that there is a predetermined distance 120 between a bottom end of the control member 90 and the bottom end of the elongate aperture 92 (see FIG. 6A). There is also a predetermined housing-plate gap 122 formed between a bottom of the housing 40 and the compactor plate 60 (See FIG. 6A). The length of distance 120 is greater that the length of the housing-plate gap 122. Accordingly, when force is applied to the compactor from above the housing 40 such as by an excavator operating the vibratory compactor 10, the housing 40 will contact the plate 60 before the control member 90 contacts the bottom surface of the elongate aperture 92.

Further, as an excavator operates to lift the vibratory compactor 10, such as from out of a ditch, if the compactor plate 60 or other component coupled to the compactor plate 60 gets caught on some object that inhibits lifting of the vibratory compactor 10, the control member 90 and the elongate aperture 92 operate to protect damage to the vibratory compactor 10. The control member 90 will move with the housing 40 as an upward force is applied on the housing 40. The compactor plate 60 and frame 20 would not move due to the contact with an obstruction to movement of the compactor plate 60. As the housing 40 moves with respect to the frame 20, the control member moves within the elongate aperture 92 until it contacts the top surface of the elongate aperture 92, as shown in FIG. 6C. This inhibits movement of the housing 40 with respect to the frame 20 and prevents damage to the isolators 80, the frame 20 and the housing 40 that may result from continued pulling on the housing 40 with the compactor plate 60 and the frame 20 in a fixed non-moving state.

It will be understood that while one size of a vibratory compactor 10 is depicted in the drawings figure, the vibratory compactor may be made in any number of various sizes depending on the type of job and the size of excavator type vehicle may be using the vibratory compactor 10. In some embodiments, particularly as the size of the vibratory compactor increases, the gap 48 may be of a size that the vibratory compactor 10 may comprise a spacer between the frame 20 and the housing 40. The spacer may be formed of ultra high molecular weight polyethylene ("UHMW") or other type of material with comparable material attributes to UHMW. Typically, the spacer is located between the frame 20 and the first and second side members 47 and 49 of the housing 40. The spacer may operate as an additional debris seal.

Figure 9:
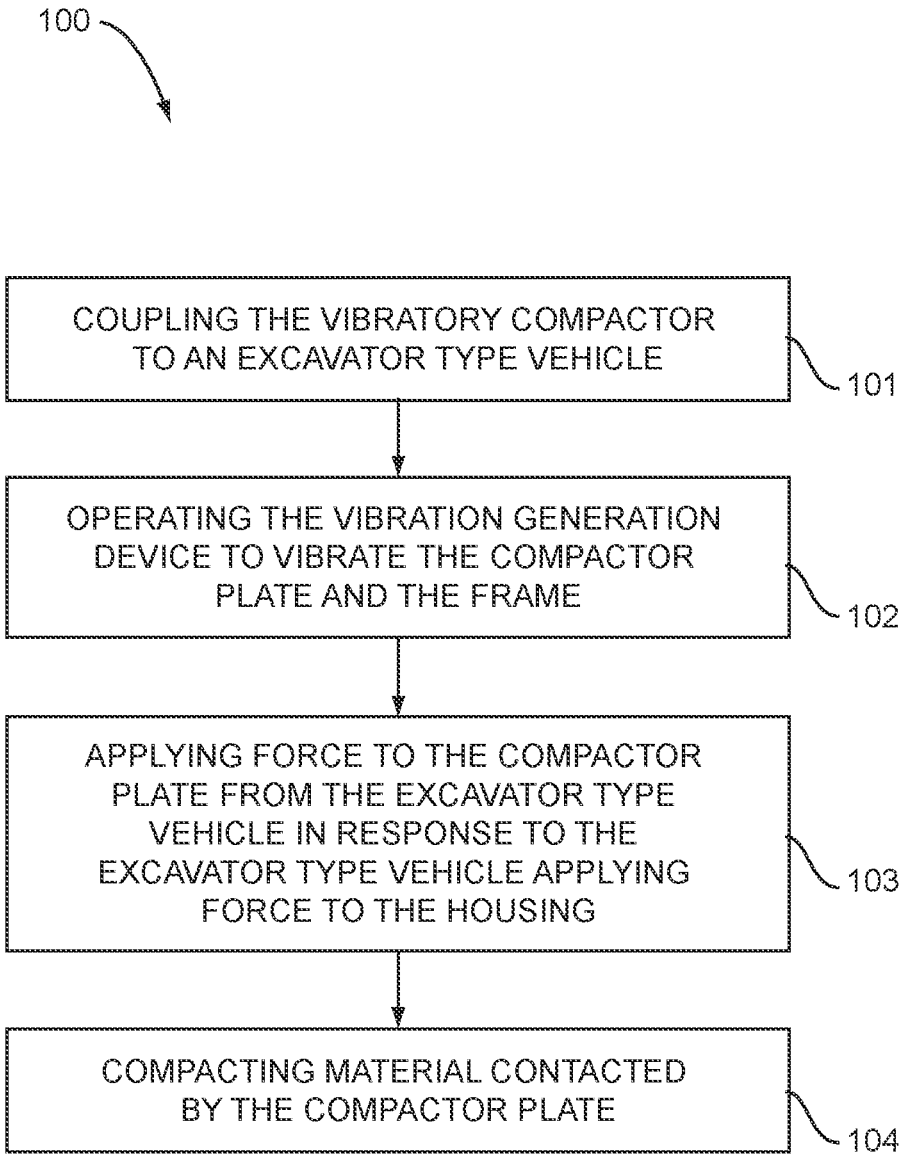
FIG. 9 is flow chart of a method of using a vibratory compactor in accordance with an embodiment.
Figure 10:
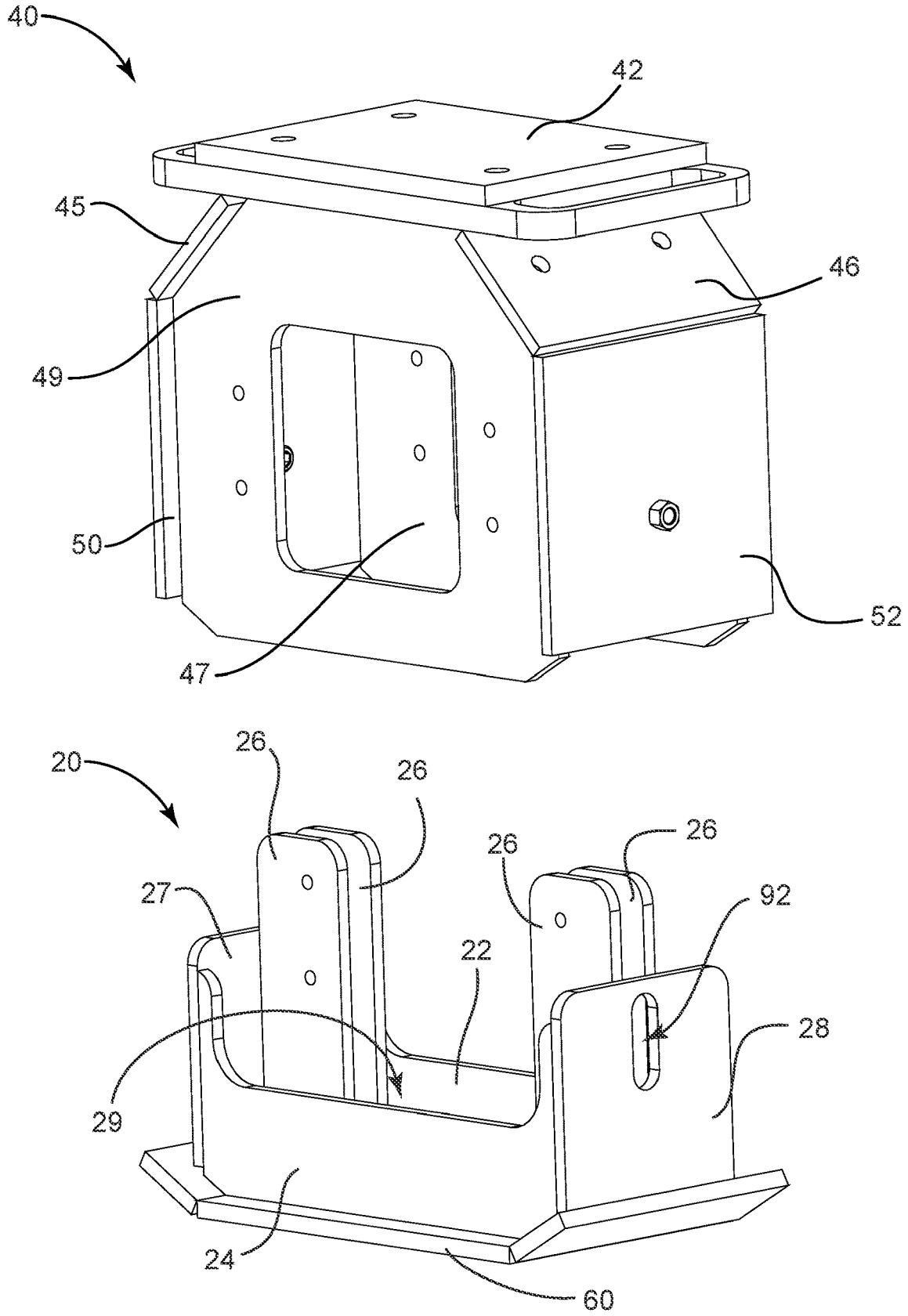
FIG. 10 is an exploded perspective view of a vibratory compactor in accordance with an embodiment.
Figure 11:
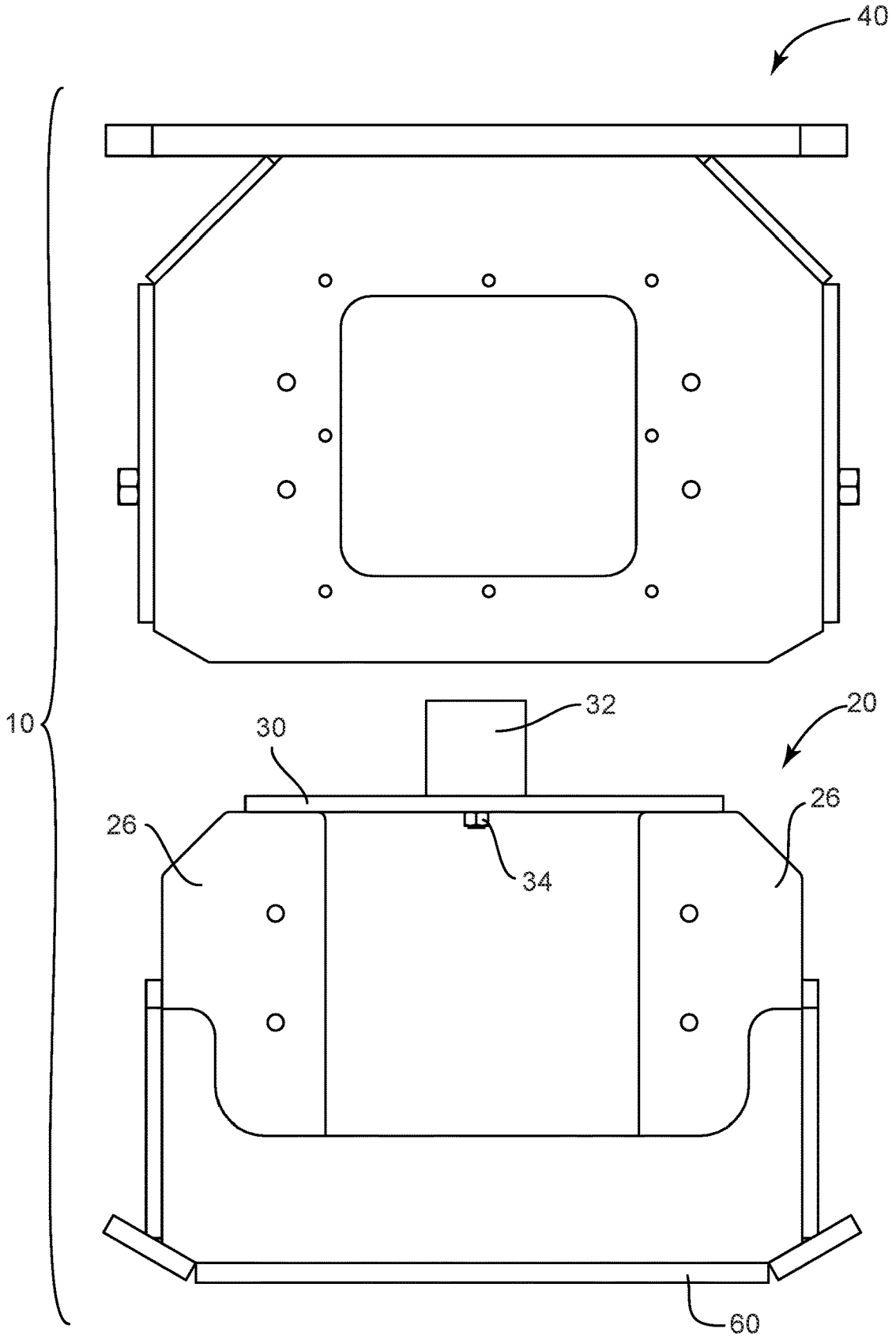
FIG. 11 is an exploded view of a vibratory compactor with a load bearing member coupled to the frame in accordance with an embodiment.
Figure 12:
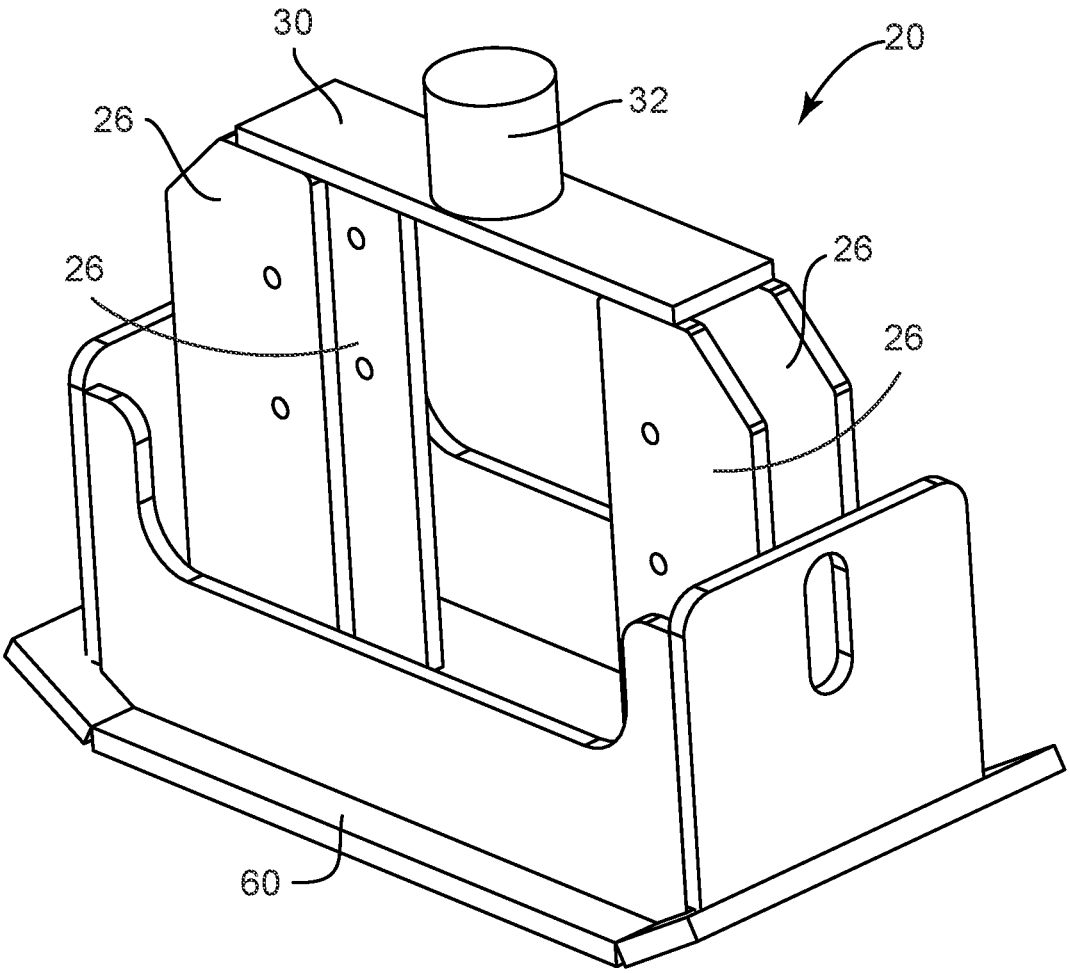
FIG. 12 is a perspective view of a frame of a vibratory compactor with a load bearing member coupled to the frame in accordance with an embodiment.
Figure 13:
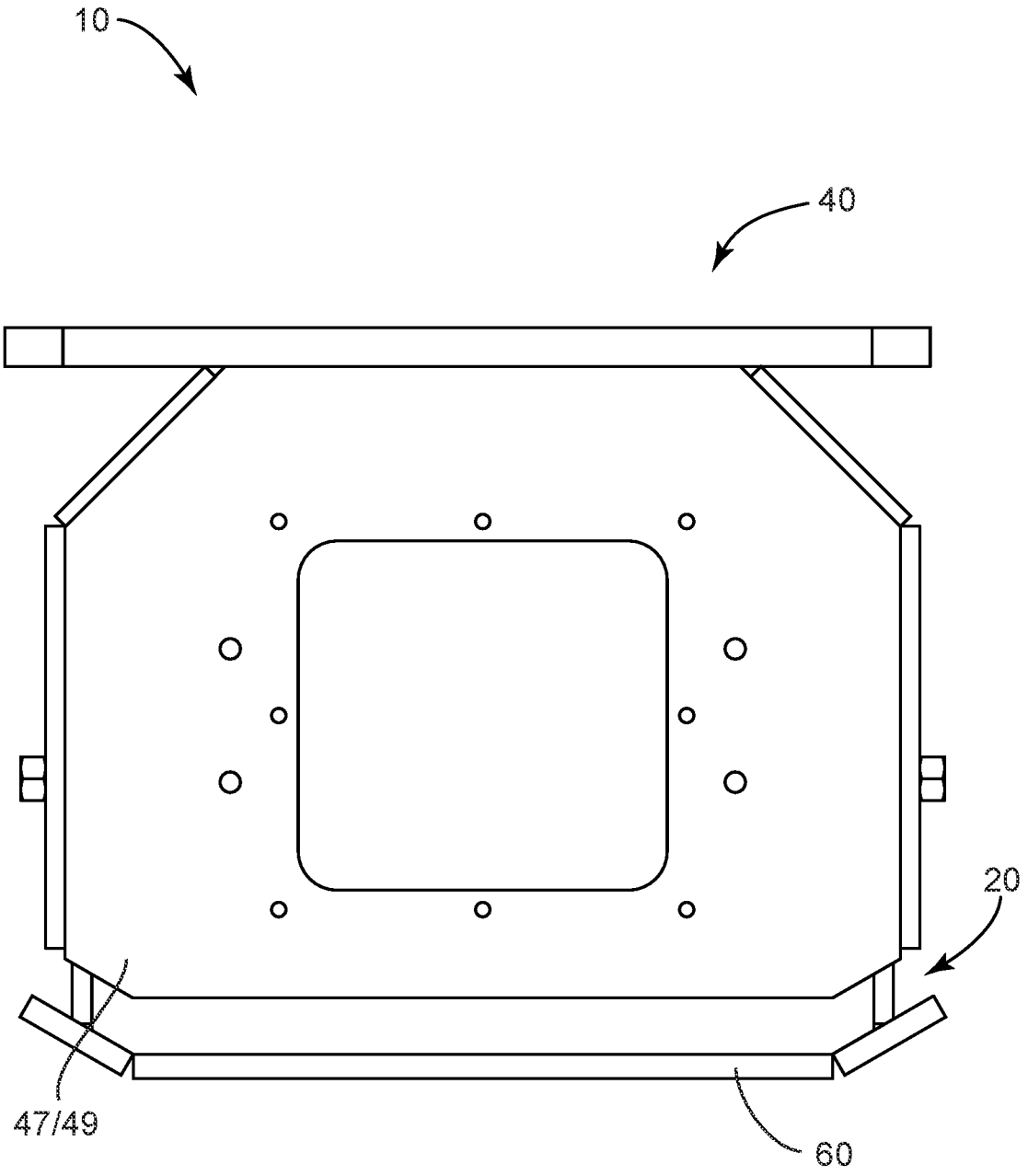
FIG. 13 is a side view of a vibratory compactor with a load bearing member coupled to the frame in accordance with an embodiment.
Figure 14:
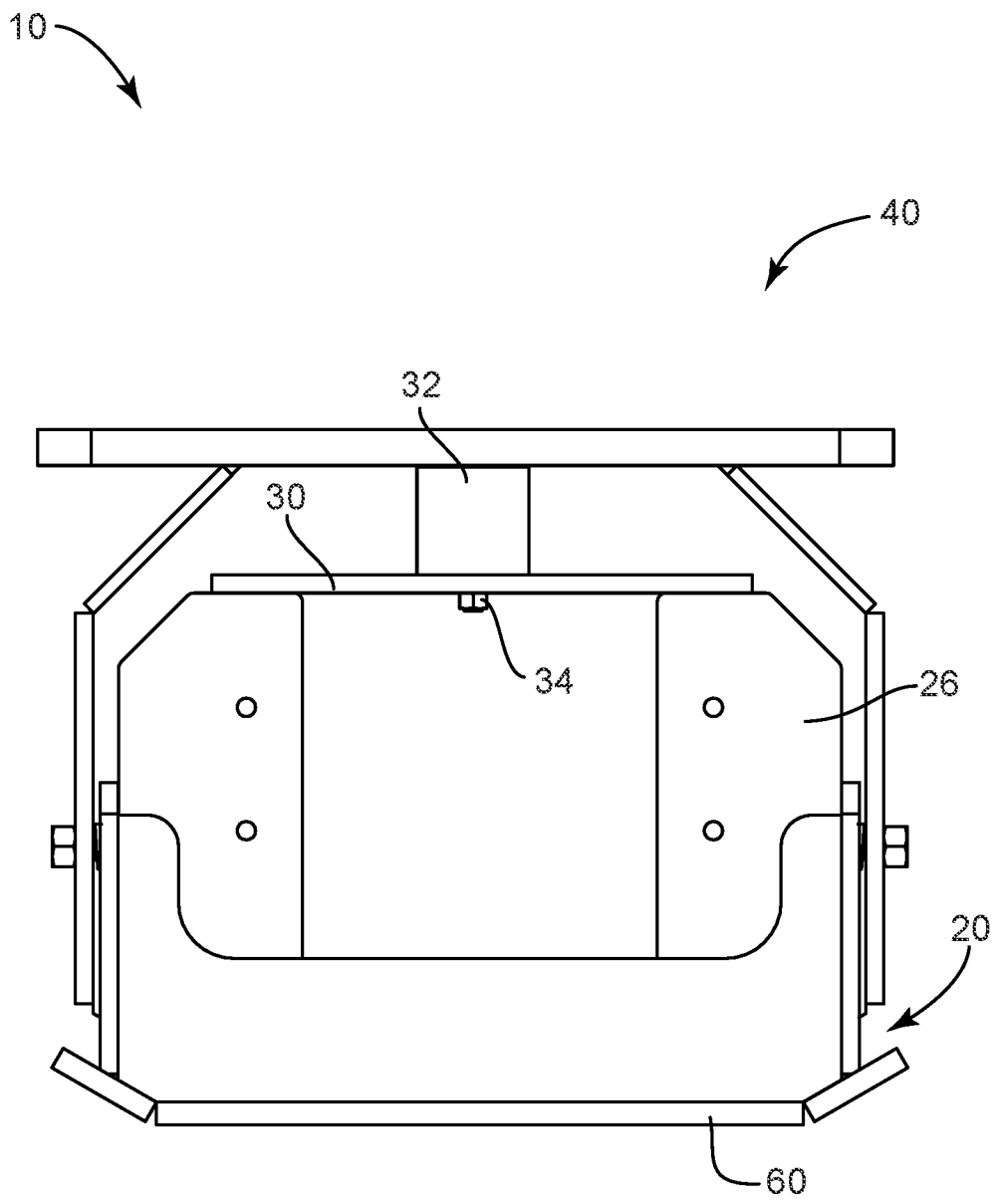
FIG. 14 is a side view of a vibratory compactor with a load bearing member coupled to the frame with a sidewall of a housing removed in accordance with an embodiment.

Referring further to the drawings, FIG. 9 depicts a method 100 of using vibratory compactor. The method 100 may comprise coupling the vibratory compactor to an excavator (Step 101), wherein the vibratory compactor comprises the components as described above; operating the vibration generation device to vibrate the compactor plate and the frame (Step 102); applying force to the compactor plate from the excavator type vehicle in response to the excavator type vehicle applying force to the housing (Step 103); and compacting material contacted by the compactor plate (Step 104).

The method 100 may further comprise isolating vibration of the compactor plate and the frame from the housing. Additionally, the Step 102 of operating the vibration generation device may comprise flowing hydraulic fluid through the vibration generation device.

Figure 8A:
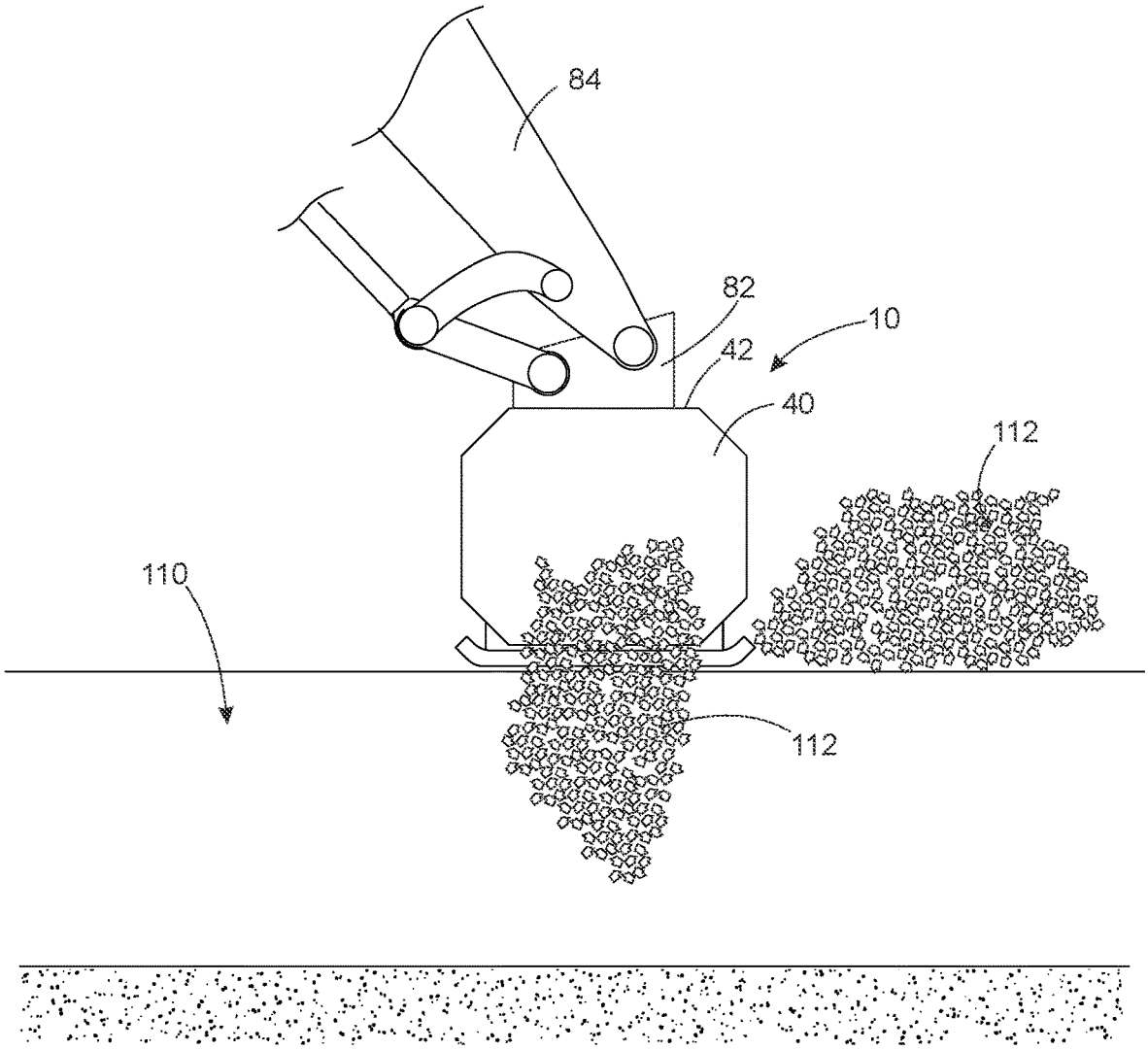
FIG. 8A is a side view of a ditch with a vibratory compactor moving material from a side of the ditch into the ditch in accordance with an embodiment.
Figure 8B:
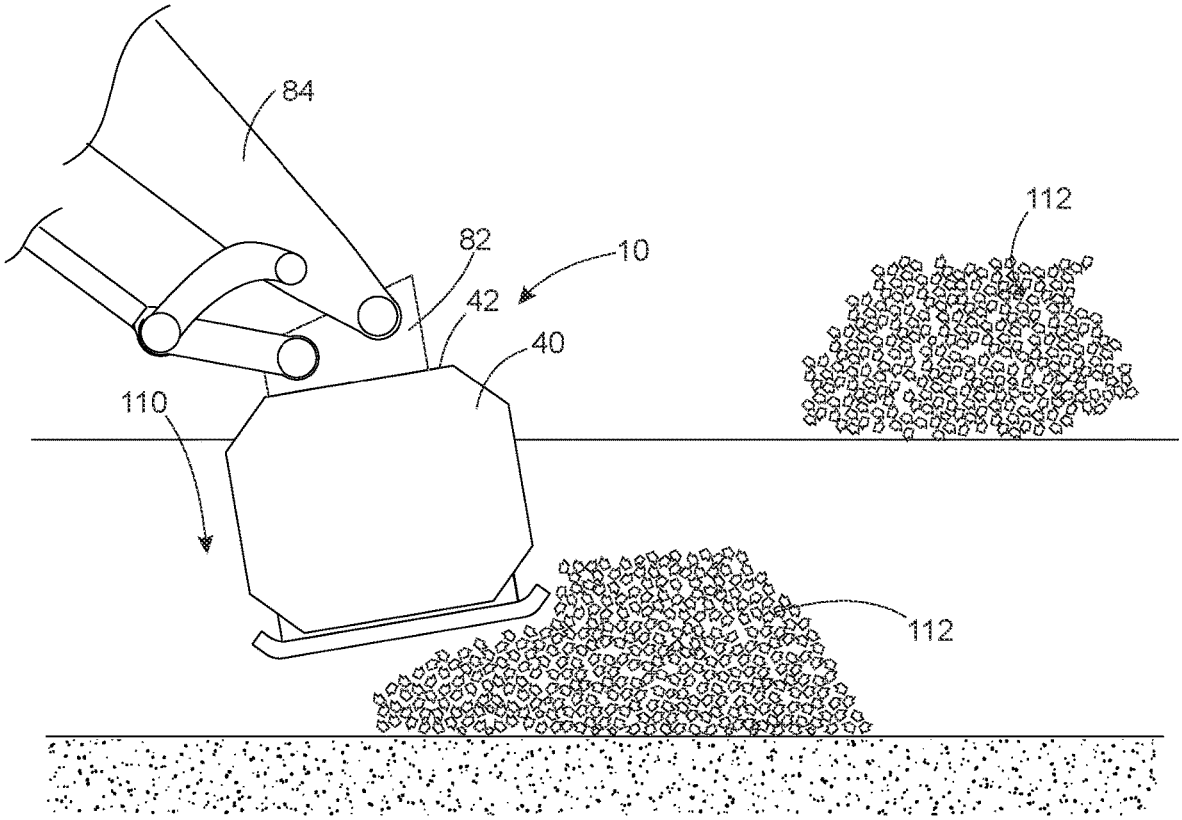
FIG. 8B is a side view of a ditch with a vibratory compactor moving material within the ditch in accordance with an embodiment.
Figure 8C:
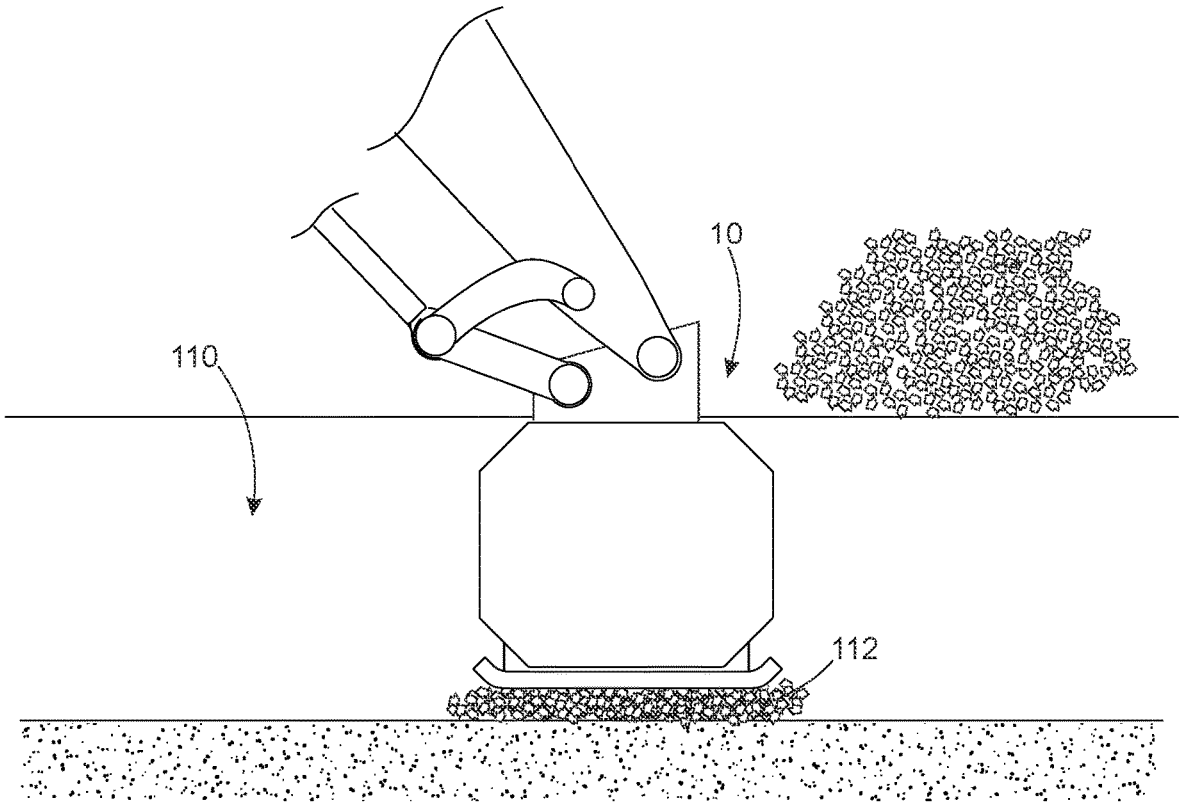
FIG. 8C is a side view of a ditch with a vibratory compactor compacting material within the ditch in accordance with an embodiment.

With further reference to FIGS. 8A-8C, the method of use may include moving material 112 from a first location to a second location, moving material in the second location and compacting material in the second location. A typical example of this is back filling and leveling a ditch that has rocky material within it. For example and without limitation, a first location may be a side of a ditch 110 to a second location within the ditch 110 with the vibratory compactor 10 as shown in FIG. 8A; moving material within the ditch 110 with the vibratory compactor 10 as shown in FIG. 8B; and compacting the material 112 within the ditch 110 as depicted in FIG. 8C. In each instance the vibratory compactor 10 may utilize couplers 82 to couple to an arm 84 of an excavator type vehicle and operate to move or scrape material from a side of the ditch 110 into the ditch 110, move material within the ditch 110 and compact the material within the ditch 110. Conventional compactors do not have the ability to perform either of these functions because the hoses, fittings and motor are all exposed and subject to damage just by trying to compact within the ditch 110 and would definitely lack the ability to scrape material into the ditch.

During operation of back filling and leveling a ditch, as described above, the method may include inhibiting movement of housing with respect to the frame by use of the control member 90 and the elongate aperture 92. This movement may be inhibited as described above with respect to FIG. 6C and provides a method of preventing damage to the isolators 80.

Referring further to the drawings, FIGS. 11-16 depict an embodiment of a vibratory compactor 10 that includes a load bearing member 32 coupled to the frame 20. In embodiments, the frame 20 may include a plurality of mounting brackets 26 or towers. As shown, embodiments may include four mounting brackets 26. A load bearing base 30 may be coupled to top surfaces of the plurality of mounting brackets 26. This coupling may include welding or coupled in other ways in order to maintain the load bearing base 30 coupled to the plurality of mounting brackets 26. The load bearing base 30 may include an aperture extending through it, that allows for a threaded stud 34 extending from the load bearing member 32 to extend through the aperture in the load bearing base. A nut may then be coupled to the threaded stud 34 in order to couple and secure the load bearing member 32 on a top side of the load bearing base 30.

The load bearing member 32 may be formed of a rubber material and may vary in its compressibility through selection of a particular durometer rubber in order to obtain the desired compression and operation as a load bearing member 32 in the vibratory compactor 10. The load bearing member 32 is only coupled to the load bearing base 30 and not to the housing 40. This allows the housing to operate as previously described wherein force applied to the top of the housing 40 during operation allows the housing 40 move with respect to the frame 20 as the compactor plat 60 is contacting a surface for compaction.

Figure 15:
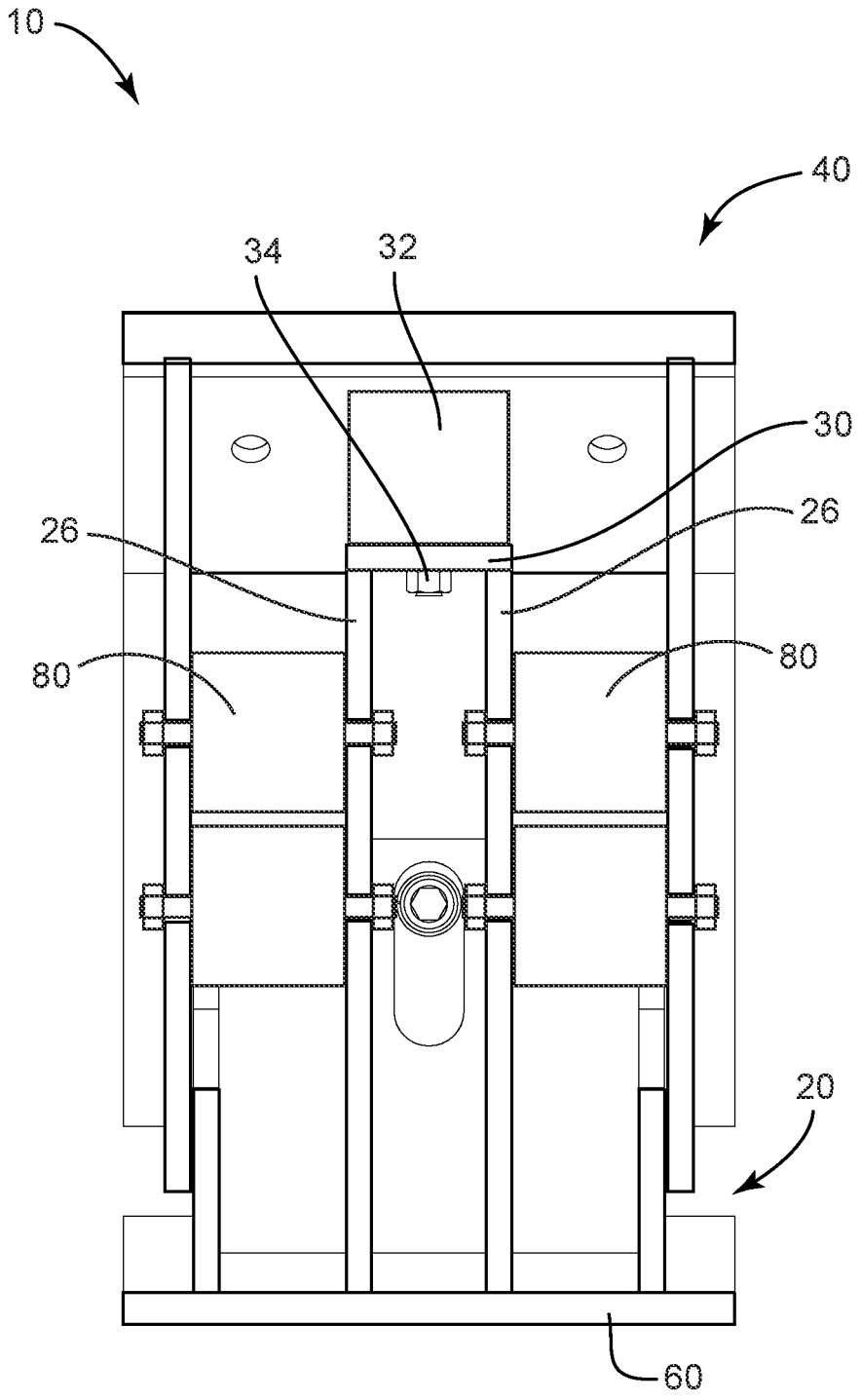
FIG. 15 is a section view of a vibratory compactor with a load bearing member coupled to the frame in accordance with an embodiment.
Figure 16:
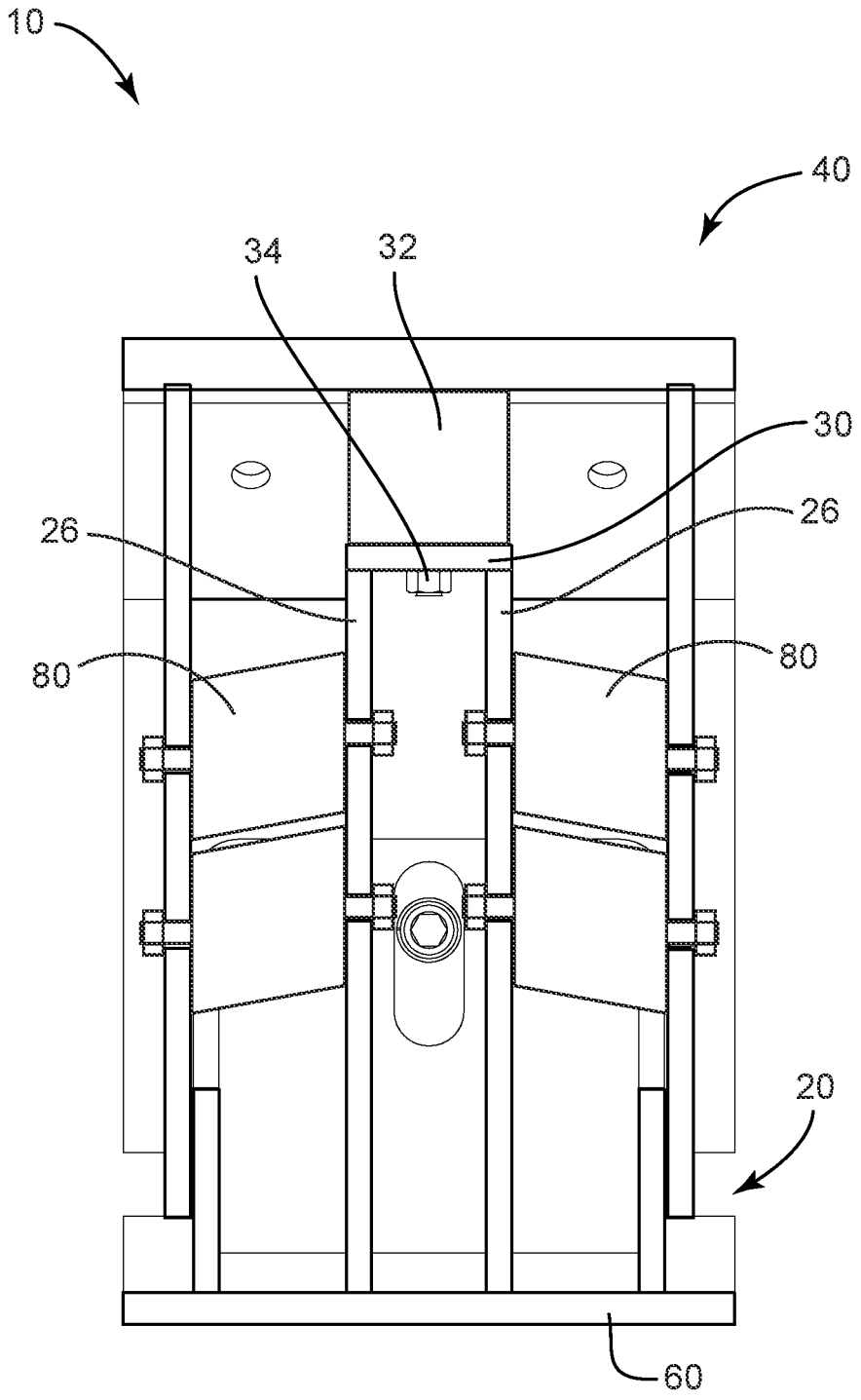
FIG. 16 is a section view of a vibratory compactor with a load bearing member coupled to the frame with a down force applied to the housing with the compactor plate in a compacting position on a surface in accordance with an embodiment.

As shown in FIGS. 15 and 16, during operation of the vibratory compactor 10. A down force applied to the housing 40 moves the housing 40 from a neutral position to a compacting position, wherein the top member of the housing 40 contacts and engages the load bearing member 32. This allows the housing 40, with force applied from the arm of the excavator, to apply increased force and better distribute the force along the compactor plate 60. Additionally, as shown in FIG. 16, with the housing 40 contacting the load bearing member 32, the isolators 80 are maintained in a more aligned position than if there is no load bearing member 32. This allows the isolators 80 to function better than without the load bearing member allowing for vibration of the compactor plate 60 to be more pronounced. This, along with the increased force that can be applied to vibratory compactor 10, results in increased vibration being applied to the surface being compacted and increasing the efficiency of the vibratory compactor 10. It will be understood that the increase force and vibration is in comparison to vibratory compactors that do not have a load bearing member 32.

Figure 17:
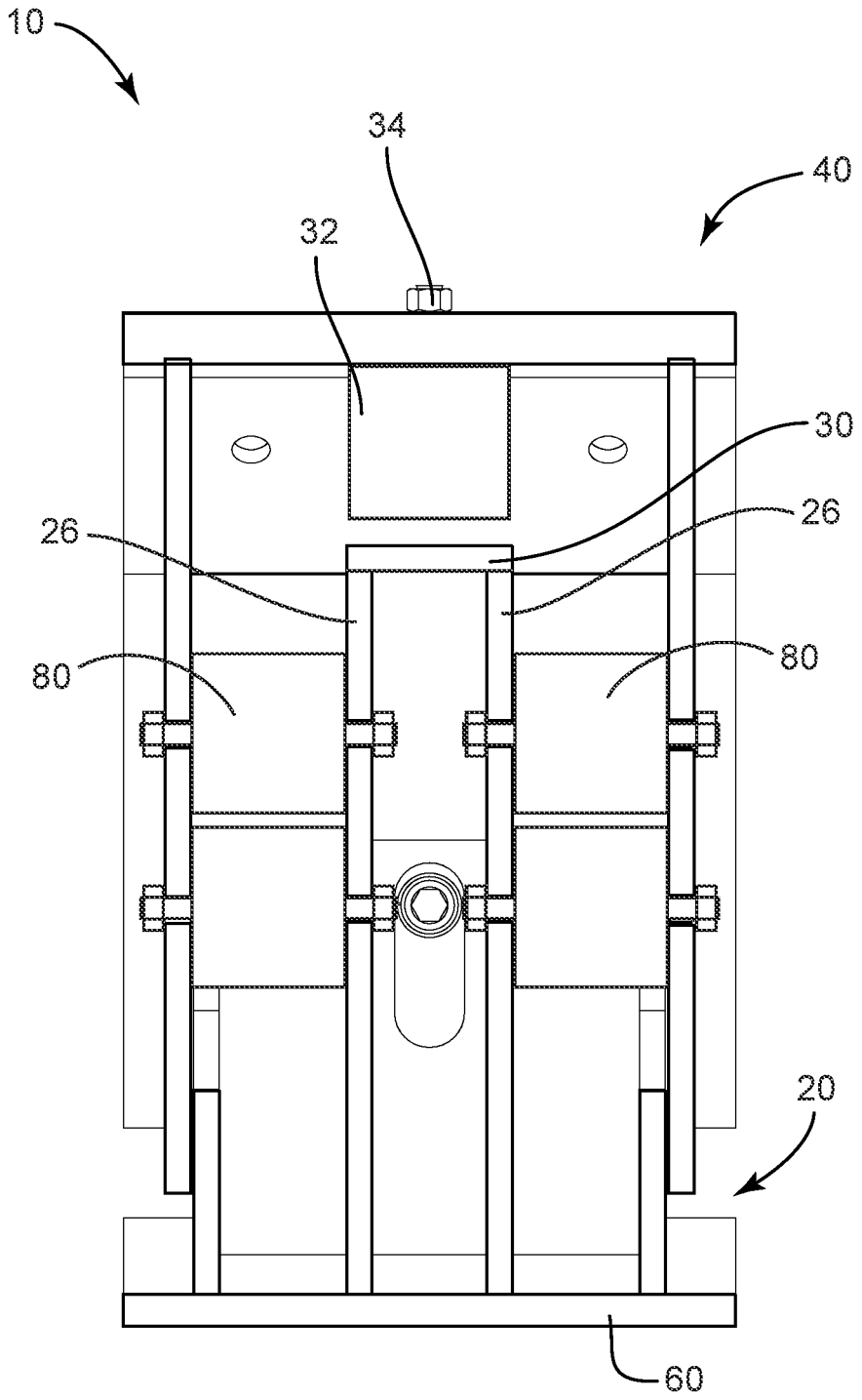
FIG. 17 is a section view of a vibratory compactor with a load bearing member coupled to the housing in accordance with an embodiment.

While it is shown in FIGS. 11-16 that the load bearing member 32 is coupled to the load bearing base 30, it will be understood that the load bearing member 32 may be coupled to a top member of the housing 40 as shown in FIG. 17. In these embodiments, the load bearing member 32 is not coupled to the base 30. When force is applied to the housing 40 from the excavator, the housing moves until the load bearing member 32 contacts the load bearing base 30 and inhibits movement of the housing 40 with respect to the frame 20 as discussed above when the load bearing member 32 is coupled to the base 30.

An embodiment may include a method of use of a vibratory compactor 10. The method may include coupling a vibratory compactor to an excavator, the vibratory compactor comprising: at least one load bearing member; a frame coupled to a compactor plate on one side and to a load bearing base on a side opposing the compactor plate; and a housing comprising an inner volume, the housing coupled to the frame by at least one isolator, the frame located within an inner volume of the housing and the at least one load bearing member located between the hosing and the frame; applying force to the housing by the excavator during compaction; moving the housing with respect to the frame until a top member of the housing contacts the at least one load bearing member on one side and the load bearing base contacts the at least one load bearing member on an opposing side; and compacting soil more effectively than a vibratory compactor without the load bearing member.

The method may further comprise steps such as isolating the vibration of the compactor plate and frame from the housing. The step of compacting soil more effectively may comprise the at least one load bearing member configured to maintain the isolators more aligned than without the load bearing member. The step of compacting soil more effectively may comprise comprises the at least one load bearing member configured to apply a greater force from the housing to the compactor plate than can be applied by a vibratory compactor without the load bearing member.

Additionally, the method may comprise the at least one load bearing member operating to evenly distribute the force applied by the excavator to the compactor plate whether or not the compactor plate is oriented parallel to a ground surface to be compacted. This allows room for some error by the operator of the excavator and still providing the same benefit. For example, the operator may orient the compactor plate 60 at a slight angle with respect to a surface to be compacted. As the operator applies force to the vibratory compactor 10 through operation of the arm the compactor 10 is coupled to, the excavator applies pressure and the load bearing member 32 then distributes the force being applied to the frame and the compactor plate, thereby allowing the compactor plate 60, because of the isolators 80, to self-orient to a position parallel with the surface being compacted. An additional benefit of this method is that is the load bearing member comprises dampening characteristics for dampening vibration up an arm of the excavator by the load bearing member.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A vibratory compactor comprising:

a load bearing member coupled to a load bearing base;

a frame coupled to a compactor plate with the load bearing base coupled to the frame, wherein the frame and compactor plate are configured to vibrate, wherein the load bearing member is centered on both a longitudinal plane and a transverse plane of the vibratory compactor; and a housing comprising an inner volume, the housing coupled to the frame by at least one isolator with the frame and the load bearing member located within the inner volume of the housing, wherein the housing is configured to couple to an arm of an excavator, and wherein:

in response to force being applied to the housing by the excavator during compaction of soil, the housing moves with respect to the frame until a top member of the housing contacts the load bearing member to evenly distribute the force to the compactor plate and compacts soil more effectively than a vibratory compactor without the load bearing member.

2. The vibratory compactor of claim 1, wherein the at least one isolator isolates the vibration of the compactor plate and frame from the housing.

3. The vibratory compactor of claim 1, wherein the vibratory compactor comprising the load bearing member compacting soil more effectively comprises the load bearing member configured to maintain the isolators more aligned than without the load bearing member.

4. The vibratory compactor of claim 1, wherein the vibratory compactor comprising the load bearing member compacting soil more effectively further comprises the load bearing member configured to apply a greater force to the compactor plate than a vibratory compactor without the load bearing member.

5. A method of use of a vibratory compactor comprising:

coupling a vibratory compactor to an excavator, the vibratory compactor comprising:

a load bearing member;

a frame coupled to a compactor plate on one side and to a load bearing base on a side opposing the compactor plate; and a housing comprising an inner volume, the housing coupled to the frame by isolators, the frame located within the inner volume of the housing and the load bearing member located between the housing and the frame, wherein the load bearing member is centered on both a longitudinal plane and a transverse plane of the vibratory compactor;

applying force to the housing by the excavator during compaction;

moving the housing with respect to the frame until a top member of the housing contacts the load bearing member on one side and the load bearing base contacts the load bearing member on an opposing side, wherein the load bearing member evenly distributes force to the frame coupled to the compactor plate; and compacting soil more effectively than a vibratory compactor without the load bearing member.

6. The method of claim 5, further comprising isolating the vibration of the compactor plate and frame from the housing.

7. The method of claim 5, wherein compacting soil more effectively comprises the load bearing member configured to maintain the isolators more aligned than without the load bearing member.

8. The method of claim 5, wherein compacting soil more effectively comprises the load bearing member configured to apply a greater force from the housing to the compactor plate than can be applied by a vibratory compactor without the load bearing member.

9. The method of claim 5, further comprising the load bearing member operating to evenly distribute the force applied by the excavator to the compactor plate whether or not the compactor plate is oriented parallel to a ground surface to be compacted.

10. The method of claim 5, further comprising dampening vibration up an arm of the excavator by the load bearing member.

* * * * *